United States Patent [19]

Short

[11] 4,067,270

[45] Jan. 10, 1978

[54] NARROW GAUGE CUT PILE TUFTING APPARATUS

[75] Inventor: Hoyt E. Short, Chattanooga, Tenn.

[73] Assignee: Tuftco Corporation, Chattanooga, Tenn.

[21] Appl. No.: 711,492

[22] Filed: Aug. 4, 1976

[51] Int. Cl.[2] ..... D05C 15/22

[52] U.S. Cl. ..... 112/79 R

[58] Field of Search ..... 112/79 R, 79 A, 79 FF, 112/79.5, 78, 266, 410, 411

[56] References Cited

U.S. PATENT DOCUMENTS

| | | | |
|---|---|---|---|
| 3,095,840 | 7/1963 | Ballard | 112/79 R X |
| 3,492,956 | 2/1970 | Webb | 112/79 R |
| 3,780,678 | 12/1973 | Short | 112/79 A |
| 3,919,953 | 11/1975 | Card et al. | 112/79 R |

*Primary Examiner*—H. Hampton Hunter

*Attorney, Agent, or Firm*—Harrington A. Lackey

[57] ABSTRACT

A cut pile tufting apparatus particularly adapted for narrow needle gauges in the order of 1/10th inch, including staggered needles and relatively thin and flexible cut pile hooks.

13 Claims, 7 Drawing Figures

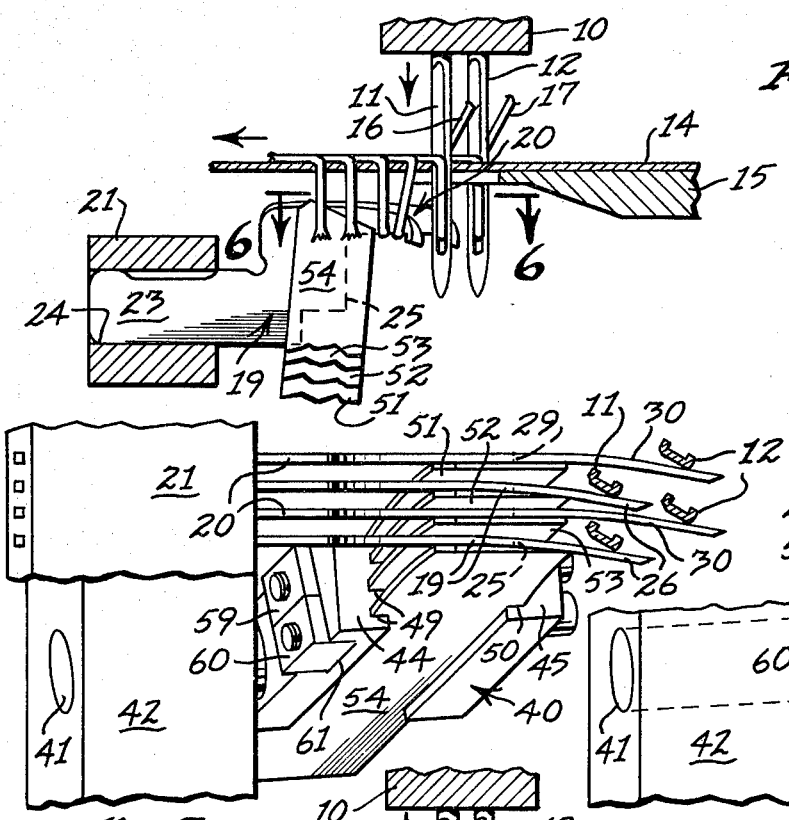
Fig. 5
Fig. 4
Fig. 3
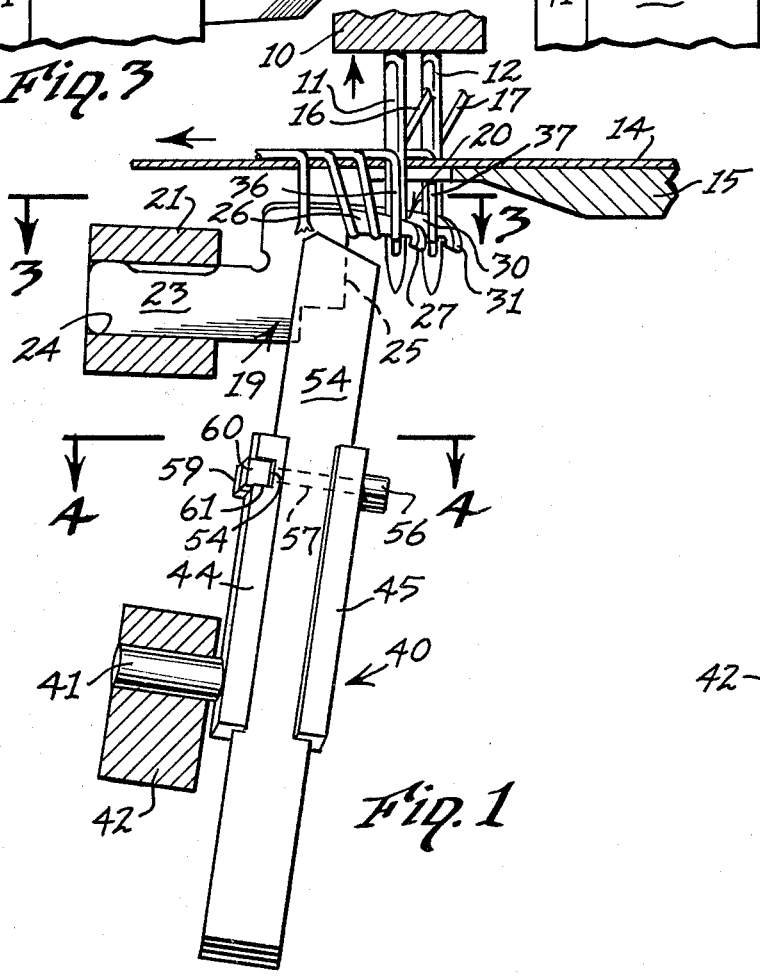
Fig. 1
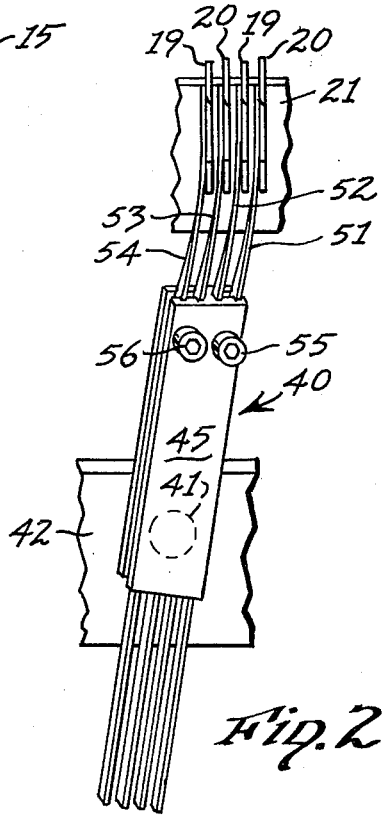
Fig. 2

NARROW GAUGE CUT PILE TUFTING APPARATUS

BACKGROUND OF THE INVENTION

This invention relates to a tufting machine, and more particularly to a narrow guage cut pile tufting machine.

In multiple needle tufting machines having needle gauges as small as 1/10th inch in a straight, single row of needles, the needles are so close together that their penetration of the cloth weakens the fabric and tears the fabric backing. Furthermore, this severly restricts the size of needles that can be used and therefore restricts also the size of yarn which can be tufted.

Previous attempts to employ staggered needles on a 1/10th inch gauge in a cut pile tufting machine have not permitted sufficient room between the needles for the hooks, knives and yarns to pass, so long as the loopers and knives are of conventional thicknesses.

Heretofore, it is has been believed that the employment of loopers and knives of lesser thickness would render the loopers and knives too weak, or at best too flexible, for satisfactorily carrying out their functions of rapidly holding and cutting the loops formed by the rapidly penetrating needles.

One of the above problems is solved in the U.S. Pat. No. 4,003,321 of Roy T Card, issued Jan. 18, 1977, for "CUT PILE APPARATUS FOR STAGGERED NEEDLE TUFTING MACHINE". In the pending Card application, the needles are staggered, but all of the hooks have bills of different lengths, so that the hook throats may be mounted in alignment, and the bills of the hooks will cross their corresponding needles by virtue of their lengths varying correspondingly to the longitudinal spacing between the rows of staggered needles. Accordingly, the knives in such a tufting machine may also be aligned, so that none of the knives have to move between any of the needles. Therefore, the knives do not clutter up the spacing between the needles, even staggered needles. However, even the needle gauge in such a staggered needle arrangement is limited by the thickness or width of the bills of the corresponding hooks.

SUMMARY OF THE INVENTION

It is therefore an object of this invention to provide a successfully operative cut pile tufting machine having a needle gauge more narrow than conventional needle gauges, in the order of 1/10th inch.

In the cut pile tufting machine made in accordance with this invention, the needles are staggered, and the hook and knife arrangement are the same as those in the above card U.S. Pat. No. 4,003,321 that is the bills of the hooks vary in length to cooperate with their respective staggered needles, while the throats of all of the hooks remain in substantial transverse alignment.

However, the width or thickness of each looper or cut pile hook is reduced to approximately ½ of the width of a conventional looper. Such reduction in width not only provides more space between the loopers and the needles, thereby permitting a narrower needle gauge, but also permits the hooks to be more flexible. Because of the increased flexibility of the hooks, each hook may be set closer to a line corresponding with the fabric feed direction and extending through the center line of the corresponding needle. In other words, the more flexible loopers may be offset a lesser distance from the center line of the needle than a conventional, thicker looper, to improve the capability of the more flexible looper to pick up a yarn loop from its corresponding needle.

Accordingly, a typical needle having a flat spot normally rotated to about 10° with respect to the longitudinal feeding axis, may be rotated even farther, as desired, tilting the scarf of the needle to a position only slightly offset from the longitudinal line extending through the center line of the needle and in alignment with the barbed end of the cut pile hook. Such an arrangement between the increased rotation of the needle and the position of the looper close to the center line of the needle permits a greater camming action as the looper strikes the scarf of the needle so that the looper has an improved capability of picking up the yarns carried by the corresponding needle. For example, a filament yarn, or an untwisted yarn, which is more difficult to pick up by a conventional looper, is readily picked up by the flexible looper employed in this invention.

Although it had been feared that the employment of a more flexible looper would create unstable and erratic performance by the cut pile forming elements, nevertheless the opposite has been found to be true. The flexing of the looper is controlled by its engagement with the scarf and the spot of the needle, so that the lateral deviation of the looper, albeit greater, nevertheless is consistent, and results in a better pickup function of the yarns carried by the needles.

Another important function performed by the more flexible looper or hook is that the hook can flex to partially conform to the pitch angle of the knife. In a machine with conventional hooks and knives, the pitch angle of each knife, which is usually about 4°, places the tip of the knife underneath the hook where it is actually in interference. In order to pass the hook cutting edge as the knife closes, the knife first must cam itself outward on the normally stiff hook. When the knife edge first contacts the cutting edge of the hook there is usually a hestitation. Then, the knife springs away enough to pass the hook edge, causing a gap to wear in the cutting edge of the hook.

With the flexible hooks embodied in this invention, the cutting action is smoother, because some of the flexing is in the hook instead of all of the flexing being in the knife. The pressure between these two parts is reduced so that the interaction is less abrupt, the wear life is increased, and a cleaner cut is produced.

BRIEF DESCRIPTION OF THE DRAWINGS

FIG. 1 is a fragmentary sectional elevation of a portion of a tufting machine incorporating this invention, disclosing the cut pile apparatus in a non-cutting position;

FIG. 2 is a fragmentary front end elevation of the looper and knife assembly disclosed in FIG. 1;

FIG. 3 is an enlarged, fragmentary section taken along the line 3—3 of FIG. 1, with portions broken away, and the yarns removed;

FIG. 4 is an enlarged, fragmentary section taken along the line 4—4 of FIG. 1;

FIG. 5 is a fragmentary sectional elevation, similar to FIG. 1, disclosing the cut pile apparatus in a cutting position;

DESCRIPTION OF THE PREFERRED EMBODIMENT

Figure 6:
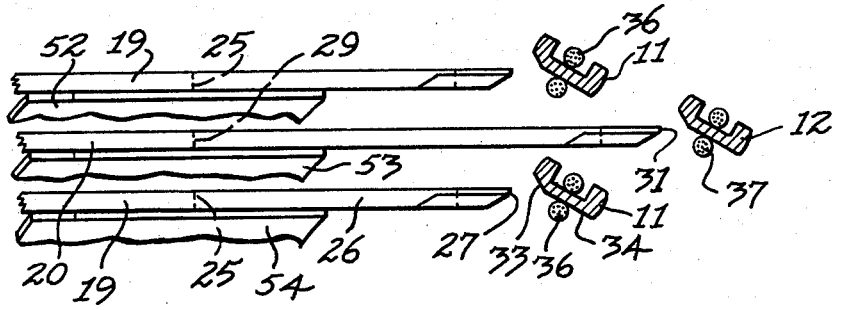
FIG. 6 is an enlarged, fragmentary section taken along the line 6—6 of FIG. 5, with some of the yarns removed.

Referring now to the drawings in more detail, FIG. 1 discloses a typical needle bar 10 supporting a plurality of needles 11 in a first or rear transverse row, and a plurality of needles 12 in a second or front transverse row spaced longitudinally forward of the first row of needles 11. The needle bar 10 is adapted to reciprocably move between its lower position disclosed in FIGS. 1 and 2, to an upper position, now shown, in which the needles 11 and 12 are above the base fabric 14. The needle bar 10 is driven by conventional means, not shown.

As best disclosed in FIG. 3, the needles 11 in the first row and the needles 12 in the second row are alternately staggered transversely of the tufting machine.

The base fabric 14 is supported upon a needle plate 15 for movement longitudinally from front-to-rear in a feeding direction, indicated by the arrow in FIGS. 1 and 5, through the tufting machine. Each needle 11 carries a yarn 16 and each needle 12 carries a yarn 17 through the base fabric 14 upon each stroke of the needle bar 10.

The cut pile apparatus made in accordance with this invention includes a plurality of first cut pile hooks 19 and a plurality of second cut pile hooks 20, all of which cut pile hooks 19 and 20 are fixedly supported upon a hook bar 21 for reciprocal movement, by conventional means, not shown.

Each cut pile hook 19 of the first set includes an elongated shank 23 adapted to fit in a corresponding slot 24 in the hook bar 21. The first cut pile hook 19 also includes a vertically disposed throat 25 from which projects in the direction opposite to the fabric feeding direction, a bill 26 of predetermined length. The point 27 of the bill 26 is barbed or downturned, in the conventional manner for cut pile hooks.

Each cut pile hook 20 of the second set is made substantially identical to the construction of a first cut pile hook 19, having a shank, not shown, identical to the shank 23, and a throat 29 identical to the throat 25. However, the bill 30 of each cut pile hook 20 of the second set is longer than the bill 26 of a first cut pile hook 19. The difference in the lengths of the bills 30 and 26 is preferably equal to the longitudinal spacing between the transverse rows of needles 11 and 12. Each bill 30 may be provided with the same downturned or barbed end 31, if desired.

Thus, by inserting the shanks of alternating first and second cut pile hooks 19 and 20 in the uniformly spaced and sized slots 24 in the same hook bar 21, the throats 25 and 29 of all the cut pile hooks 19 and 20 will be transversely aligned, as indicated in FIG. 3. However, the bills 26 and 30 being of alternately different lengths, will project a corresponding amount across each alternately staggered needle 11 and 12, as best disclosed in FIG. 3.

In a conventional cut pile tufting apparatus, and even in the cut pile tufting apparatus disclosed in the above card U.S. Pat. No. 4,003,321, the width or thickness of the hooks 19 and 20 are of a conventional or standard size, which is about 0.055 or 0.060 inches. Such hooks have been used with needles whose overall diameters are approximately 0.120 or 0.125 inches. A typical fine or narrow needle gauge is approximately ⅛ inch or 5/32nds inch, even where the needles are staggered.

In the apparatus made in accordance with this invention, the needles remain of conventional size, that is about 0.120 or 0.125 inches in overall diameter. However, the needle gauge has been reduced to 0.10, and the thickness or width of each of the loppers or hooks 19 and 20 has been reduced by about ½ to a hook thickness of 0.032 inches. The hooks 19 and 20 are made out of the same steel from which conventional hooks are made, but by virtue of their reduction in width, they are more flexible so that they more readily yield or flex, and are deviated laterally when the barb of each of the hooks 19 and 20 engages its corresponding needle 11 and 12 for camming action along the side of the needle to pick up the respective yarns 16 and 17.

By virtue of this greater flexibility in the hooks 19 and 20, they may be set laterally or transversely closer to the center line of their corresponding needle, as indicated in FIG. 6.

Since the more flexible hooks are located transversely closer to the center line of each needle, each needle may be rotated to bring the scarf 33 of the respective needle also closer transversely to the center line of its respective needle, so that each scarf 33 is longitudinally opposing the barbed end 27 and 31 of the respective looper 19 and 20.

Typically, the needle spot 34, which is the flat planar side surface of the needle, is disposed at approximately 10° to the longitudinal direction of fabric feed in a conventional cut pile tufting machine. In this invention, the needle spot may be rotated to an angle of 10° or more, or even slightly less to the longitudinal direction of fabric feed in order to locate the scarf 33 in opposition to, and in longitudinal alignment with, its corresponding looper 19 or 20. A preferred angular range of the needle spot to the fabric feed direction would be 5°–20°.

Figure 7:
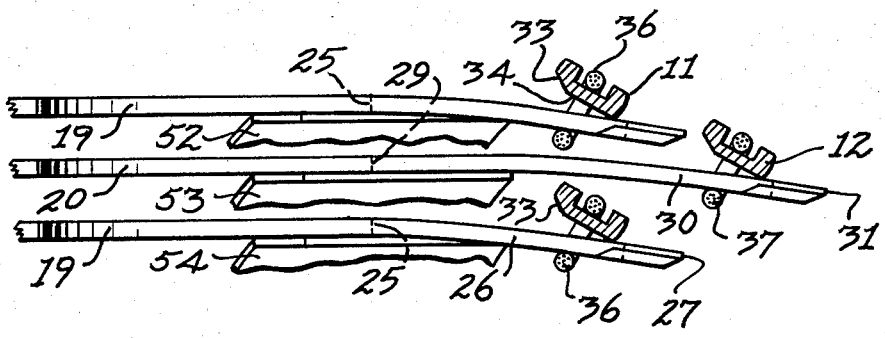
FIG. 7 is a view similar to FIG. 6, showing the flexible loopers picking up the yarns from the needles.

As illustrated in FIG. 7, as each hook 19 and 20 crosses its respective needle 11 and 12, the scarf 33 and spot 34 of the needle cam the respective barbed end 27 and 31 of the corresponding hook laterally outward, but in tensioned engagement with the corresponding needle, causing the barbed end of each respective looper to better engage the respective yarns 16 and 17 and hold the respectively formed loops 36 and 37 thereon.

The cutting apparatus for this narrow gauge cut pile tufting machine includes a knife holder or knife block 40, having a shank 41 fitted within a corresponding recess in a knife bar 42.

The shank 41 supports the knife block 40 at a predetermined pitch angle, such as 4° to the longitudinal transverse axis of the knife bar 42. The knife bar 42 is adapted to reciprocate about its longitudinal or rocking axis in a conventional manner. The knife block 40 includes an elongated web 43 terminating in a pair of flanges 44 and 45 disposed substantially at right angles to the web 43. The cross section of knife block 40 resembles an I-beam.

The opposed innerfaces of the flanges 44 and 45 are cut to form opposed knife recesses for channels or tracks 47, 48, 49 and 50. The tracks 47 and 48 are on one side of the web 43, while the tracks 49 and 50 are on the opposite side of the web 43. The spacing and sizes of the knife recesses 47, 48, 49 and 50 are such as to snugly but slidably receive longitudinally within the recesses the respective knives or knife blades 51, 52, 53 and 54.

In order to save as much space as possible and to bring the knives 51 – 54 as close as possible to conform to the narrow gauge of needles 11 and 12, the innermost recesses 47 and 48 on one side of the web 43 and the innermost recesses 49 and 50 on the opposite side of the web 43 may be formed so that one of their walls is flush with each face surface of the web 43, as best disclosed in FIG. 4.

In order to secure the knives 51 - 54 within the knife block 40, a pair of headed bolts 55 and 56 are inserted through corresponding openings within the flange 45 of the knife block 40 so that the shanks 57 extend between the corresponding respective blades 51 - 52 and 53 - 54, and extend through mating openings in the opposite flange 44. The free ends of the bolts 55 and 56 are threaded to cooperate with threaded square nuts 59 and 60. The square nuts 59 and 60 are seated in a transverse recess 61 of the flange 44. The bottom of the recess 61 extends depthwise into the flange 44 far enough to intercept the recesses 47 and 49. Thus, when the nuts 59 and 60 are tightened upon the respective bolts 55 and 56 to a sufficient degree, they actually engage the corresponding edges of the knives 51 - 54 to bind and hold the knives in their respective positions within the block 40. This binding effect is best disclosed in FIG. 1 illustrating the nut 60 engaging the edge of the knife blade 54.

The shank 41, as best disclosed in FIG. 2, is rotated within the knife bar 42, in a conventional manner, to dispose the knife block 40 at an angle to the knife bar 42 to effect a tension angle between the respective blades 51 - 54 and the sides of the cut pile hooks 19 and 20. The typical tension angle would be 9°. Thus, as disclosed in FIGS. 1 - 4, the knife block 40 is set not only at a pitch angle of approximately 4° to the knife bar 42, but also at a tension angle in a different dimension of approximately 9° to hooks 19 and 20.

Because of the pitch angle, the knives, such as knives 51 - 54, would be aligned with each other in a line at an angle to the alignment of the hooks and the needles. Therefore, in order to accommodate for this disalignment of the knives with the hooks, the knives 51 and 52, in alignment with each other, are staggered relative to the aligned knives 53 and 54 by an offset amount X, as disclosed in FIG. 4. It is not felt that every knife has to be offset with every adjacent knife because of the closeness of the gauge. Accordingly, only every pair of knives 51 - 52 and 53 - 54 in each block 40 is offset from the other pair by the amount X.

Thus, the recesses 47 are aligned with each other, but are offset by the amount X from the recesses 49. Correspondingly, the recesses 48 are offset by the same amount X from the recesses 50 in the opposite flange 45. In this manner, substantial alignment of the knives 51 - 54 is preserved with the alignment of the hooks 19 and 20, as best disclosed in FIG. 3.

It will thus be seen that in the knife block 40, the knives 51 - 54 may be spaced closer together to correspond with a narrow needle gauge, in the order of 1/10th inch. It is within the scope of this invention to provide a knife block 40 having recesses offset at least in pairs for accommodating a multiple number of knife blades greater than four. However, the knife block 40 with its shank 41 is adapted to fit within corresponding holes having conventional spacing in a conventional knife bar.

What is claimed is:

1. In a cut pile tufting machine having a plurality of needles, a looper cooperating with each of said needles, and a knife cooperating with each of said loopers for cutting yarns on said loopers to form cut pile, knife support means comprising:

a. a reciprocal knife bar having a rocking axis substantially parallel to the transverse alignment of said needles, b. at least one knife block, said knife block having a longitudinal axis, c. means securing said knife block to said knife bar at a predetermined pitch angle, d. a plurality of opposed pairs of recesses formed longitudinally in said knife block, each pair of recesses being adapted to slidably receive one of said knives at said pitch angle, e. at least one pair of said recesses being staggered relative to another pair of said recesses to support said knives in substantial alignment parallel to the rocking axis of said hook bar.

2. The invention according to claim 1 in which each of said knife blocks has four pairs of recesses, two pairs of said recesses on one side of said knife block being staggered relative to the two pairs of recesses on the opposite side of said knife block, whereas one pair of knives received in said recesses on one side of said knife block are staggered relative to another pair of knives received in said recesses on the opposite side of said knife block.

3. In a tufting machine having means for supporting a base fabric for longitudinal movement in a feeding direction through said machine, a narrow gauge tufting apparatus comprising:

a. a first row of uniform first needles movable in reciprocal axial paths for introducing yarns through the base fabric to form first loops, said first needles being uniformly spaced transversely of said longitudinal feeding direction, b. a second row of uniform second needles movable in reciprocal axial paths for introducing yarns through the base fabric to form second loops, said second needles being uniformly spaced transversely of said longitudinal feeding direction, c. said second needles being uniformly and transversely staggered relative to said first needles so that the transverse distance between adjacent longitudinal vertical planes containing the axes of said first and second needles is a uniform narrow gauge, d. said uniform narrow gauge being less than the transverse dimension of each of said uniform needles, e. said first and second rows of needles being longitudinally spaced apart a predetermined distance substantially greater than said narrow gauge, f. a first hook for each first needle, said first hook having a throat and a bill projecting from said throat, g. a second hook for each second needle, said second hook having a throat and a bill projecting from the throat of said second hook, h. reciprocal hook bar means extending transversely of said feeding direction adjacent said fabric supporting means, i. means fixing each hook to said hook bar means so that the bill of each of said hooks extends longitudinally in a hook path intercepting the axial path of its corresponding needle, j. said hook bar means being reciprocable to move each said bill between an inoperative position spaced from and projecting toward its corresponding needle and an operative position engaging said corresponding needle, k. each of said bills having a uniform narrow width substantially less than said gauge and being relatively more flexible than its corresponding needle, so that said bill flexes transversely of its corresponding needle and said longitudinal feeding direction as said bill engages its corresponding needle and moves toward its operative position.

4. The invention according to claim 3 in which each of said hooks is a cut pile hook and further comprising a knife for each of said first and second cut pile hooks, knife supporting means supporting each of said knives for reciprocable cooperative movement with a corresponding hook to form first and second transverse rows of cut pile tufts.

5. The invention according to claim 4 in which each of said bills is adapted to flex transversely away from its corresponding knife as said knife cooperates with said corresponding bill to cut a yarn loop carried by said bill.

6. The invention according to claim 5 in which each of said knives is mounted at a predetermined pitch angle in said knife supporting means, and each of said bills has a cutting edge adapted to cooperate with the corresponding pitched knife for cutting the yarn loop carried by said bill.

7. The invention according to claim 5 in which each of said knives is mounted on the opposite side of its corresponding bill from the side of the bill that engages its corresponding needle, said bill being adapted to flex toward its corresponding knife when said bill engages its corresponding needle.

8. The invention according to claim 4 in which the throats of all said hooks are transversely aligned, the bills projecting from the throats of said first cut pile hooks being of a predetermined length, the bills projecting from the throats of said second cut pile hooks being of a length different from the length of the bills of said first cut pile hooks by an amount substantially equal to the longitudinal spacing between said first and second transverse rows of needles, and all said knives being in substantial transverse alignment parallel to the alignment of the throats of said bills.

9. The invention according to claim 3 in which each of said needles has a flattened side including a needle spot terminating in a scarf, each of said needles being disposed at a uniform angle between said needle sport and said corresponding hook of approximately 5°–20°.

10. The invention according to claim 3 in which each of said needles has a flattened side surface including a needle spot terminating in a scarf opposing said corresponding hook, the angle between said needle spot and said feeding direction being such that said scarf is offset slightly on the side of said needle spot from a longitudinal line extending through the center of said needle.

11. The invention according to claim 3 in which each of said bills is adapted to flex a transverse distance from the longitudinal normal axis of said bill at least twice as great as the width of said bill.

12. The invention according to claim 4 in which said knife-supporting means comprises a reciprocal knife bar and at least one knife block, means fixing each of said knife blocks to said knife bar at a predetermined pitch angle, and means in each of said knife blocks for receiving a plurality of knives in staggered relationship in said knife block and substantially in parallel alignment with the longitudinal axis of said knife bar.

13. The invention according to claim 12 in which the means for receiving said knives in said knife block comprises pairs of opposed aligned recesses for slidably receiving the longitudinal edges of each of said knives, at least some of said pairs of recesses being staggered relative to another pair of recesses in said knife block.

* * * * *